US005540115A

United States Patent [19]

Levy

[11] Patent Number: 5,540,115

[45] Date of Patent: Jul. 30, 1996

[54] ERGONOMIC THUMBWHEEL

[76] Inventor: David H. Levy, 16 Blake St., Cambridge, Mass. 02140

[21] Appl. No.: 393,806

[22] Filed: Feb. 24, 1995

[51] Int. Cl.[6] ..... H01H 19/14; G05G 1/10

[52] U.S. Cl. ..... 74/553; 74/10 R; 200/11 TW; 116/307; 116/309

[58] Field of Search ..... 74/553, 555, 10 R; 200/11 TW; 116/223, 307, 309, 318

[56] References Cited

U.S. PATENT DOCUMENTS

| | | | |
|---|---|---|---|
| 2,713,318 | 7/1955 | Paulstich | 74/10 |
| 3,999,021 | 12/1976 | Delp | 74/553 |
| 4,890,572 | 1/1990 | Huang | 116/318 |

FOREIGN PATENT DOCUMENTS

| | | | |
|---|---|---|---|
| 879468 | 10/1961 | United Kingdom | 74/553 |

OTHER PUBLICATIONS

*Product Engineering*, "Right color plus dial shape minimizes operator errors", Apr. 25, 1966, pp. 84–85.

*Product Engineering*, Mar. 1951, p. 135.

*Primary Examiner*—Rodney H. Bonck

*Assistant Examiner*—Mary Ann Battista

[57] ABSTRACT

The outside perimeter contact surface is molded with a continuously varying outer radius as measured relative to the axis of rotation and concentric circles of contrasting color disposed on the lateral surface of the thumbwheel with centers located at axis of rotation thereby providing visual and tactile feedback to the user of the character of output signal.

10 Claims, 1 Drawing Sheet

ERGONOMIC THUMBWHEEL

FIELD OF THE INVENTION

This invention is in the field of ergonomic control knobs, particularly thumbwheels.

BACKGROUND OF THE INVENTION

There is a growing awareness of the importance of the man-machine interface. The issues range from the mundaneness of simply wanting to have "an intuitive interface" on a consumer item for the purposes of "ease-of-use," to the opposite extreme of life-and-death issues surrounding the accidental misoperation of a control knob in a nuclear power plant, airplane, or automobile.

This invention deals specifically with thumbwheels: radial knobs with the axis of rotation parallel with and submerged from an exposed surface. Thumbwheels offer the advantages of a compact size and a clean appearance without protrusions which can catch accidentally on passing objects.

However, the existing thumbwheels have severe problems with regard to ergonomics. The thumbwheel interface commonly used on many portable CD players as a volume control serves as an ideal example.

Prior to pressing the "play" button, the user must try to remember whether the device was last used at high volume or low volume. If it were last used on a high volume setting, the device may blare loudly at a time when loudness is undesirable. While this problem could be solved with small numbers molded into the material of the knob, designers commonly desire only a fraction of an inch of the thumbwheel edge to protrude, for the reasons offered above. One practical solution to this problem is for the user to arbitrarily lower the volume as a precaution against it starting to play too loudly.

This "solution" highlights the second problem of existing thumbwheel designs: It is difficult for the user to ascertain which direction to turn the knob to achieve a desired goal. Commonly, there is a graphic molded into the plastic case indicating which direction is louder. However, in accordance with the small overall size of the product, this graphic is small and difficult to read. It is additionally difficult to read because the graphic is made of the same material and color as the case, requiring the user to move their head or the device until the graphic becomes identifiable. Furthermore, it is even more difficult to read this information during the common situations of darkness, while driving, exercising etc. This example highlights the problems of all existing thumbwheel interfaces, regardless of application.

What is desirable is a means to provide information about the status of the thumbwheel control to the user, regardless of whether the device is on or off.

It is also desirable to provide directional information to the user in such a way that the information can be conveyed during the adverse conditions in which products are commonly used: while driving, in darkness, while exercising, etc.

Finally, it is desirable to achieve these goals with negligible increase to the manufacturing cost.

SUMMARY OF THE INVENTION

In this invention the above limitations are overcome and objects and advantages achieved by molding the contact surface, located at the outside periphery, with an outer radius which varies continuously as measured relative to the axis of rotation, a shape commonly referred to as a spiral or nautilus shape.

The advantages of this shape are numerous and surprising. As the thumbwheel is rotated, the surface projects further from the housing, providing a visual feedback to the user of the output level of the electronic signal. The visual feedback may be amplified by printing a graphic, preferably of contrasting color onto the lateral surface of the thumbwheel. The preferred embodiment uses thin concentric circles for this purpose. The result is an easily read scale which indicates the angular position of the thumbwheel, and hence the magnitude of the control parameter. The circles may be spaced irregularly to add more information.

An additional advantage is that the spiral shape provides tactile feedback when the user touches it. As the thumbwheel is rotated in the direction of increasing radius, the contact surface is displaced outward causing an increased force on the user's finger. And, as the thumbwheel is rotated in the direction of decreasing radius, the contact surface is displaced inward causing an decreased force on the user's finger. Therefore, the user may detect the proper direction to minimize the control with the most minute movement and without looking. Users with a delicate touch can identify which direction represents a magnitude increase merely by contacting the slope of the thumbwheel spiral.

Further, the additional cost of this improved thumbwheel is negligible. A mold maker using CNC can produce a spiral-shaped thumbwheel for the same price as a round thumbwheel.

It is therefore a goal of the present invention to provide status information about the position of the thumbwheel control to the user, even when the device is turned off.

It is a further goal to provide information about which direction represents increasing magnitude to the user in such a way that the information can be conveyed without looking and thereby during the adverse conditions in which consumer products are commonly used: while driving, in darkness, while exercising, etc.

And, is the final goal to achieve the prior goals with negligible increase in the manufacturing cost.

DETAILED DESCRIPTION

Figure 1:
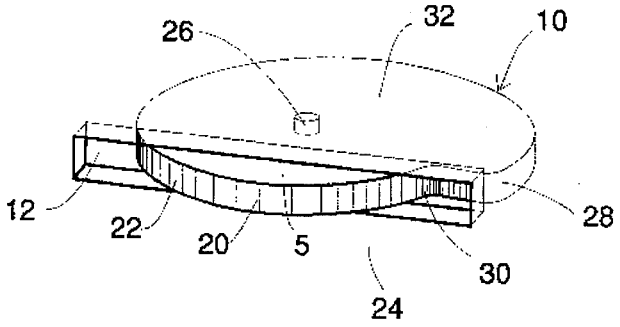
FIG. 1 shows an isometric view of a typical embodiment of the present invention drawn in position of minimal projection of the contact surface.

FIG. 1 shows the exposed portion 5 of thumbwheel 10 as it protrudes though slot 12. Contact surface 22 is the radial periphery of the thumbwheel 10. The contact point 20 is defined as the intersection of the radial periphery and a plane that lies approximately perpendicular to said housing surface 24 and passes through axis of rotation 26. The user contacts the thumbwheel 10 at the contact point 20. The thumbwheel 10 rotates on axis of rotation 26. The contact surface 22 is spiral shaped: it includes a continuously varying radius as measured with respect to said axis of rotation 26. The maximum point 28 and minimum point 30 are located at either angular extreme of the contact surface 22. The significance of the maximum point 28 and minimum point 30 are only geometric. The functional significance occurs at the location where the user touches the device, at the contact point 20. As the thumbwheel 10 is rotated counterclockwise the distance between the contact point 20 and the housing surface 24 will increase. This dimensional increase places an increased force on the user, thereby indicating the direction of rotation. Also, the increased dimension is a large-scale visual metric which indicates the status of the thumbwheel to the user. Lateral surface 32 lies perpendicular to the axis of rotation 26.

Figure 2A:
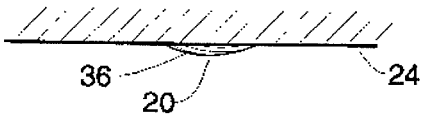
FIG. 2*a* shows an external view of the thumbwheel at a minimum position.

FIG. 2*a* shows an external view of the present invention rotated to the extreme position in which the contact point 20 is closest to the housing surface 24. Magnitude scale 36 is disposed on lateral surface 32. In the preferred embodiment, the magnitude scale 36 consists of concentric circles located at axis of rotation 26.

Figure 2B:
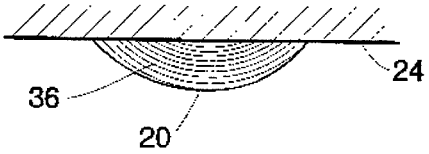
FIG. 2*b* shows an external view of the thumbwheel at a maximum position.

FIG. 2*b* shows an external view of the present invention rotated to the extreme position in which the contact point 20 is farthest from the housing surface 24.

Figure 3A:
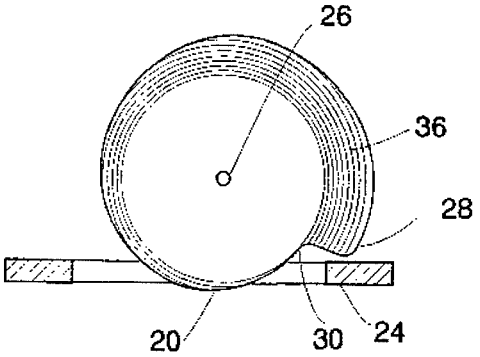
FIG. 3*a* shows a cut-away view of the thumbwheel at a minimum position.

FIG. 3*a* shows a cut-away view with the thumbwheel rotated to a minimum position. The maximum point 28 is rotated behind the housing surface 24 and the minimum point 30 is near the housing surface 24. Magnitude scale 36 is disposed on lateral surface 32.

Figure 3B:
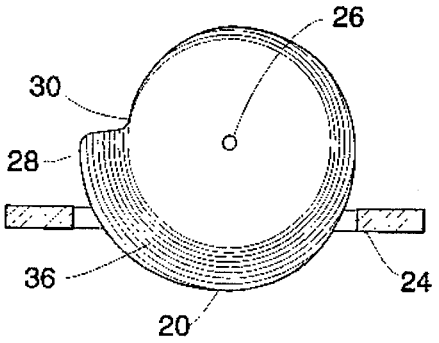
FIG. 3*b* shows a cut-away view of the thumbwheel at a maximum position.

FIG. 3*b* shows a cut-away view of the thumbwheel at a maximum position. In the maximum position, the maximum point 28 is rotated behind the housing surface 24 and the minimum point 30 is located near the housing surface 24.

While particular embodiments of the particular invention have been shown and described, it will be obvious to those skilled in the art that changes and modifications may be made without departing from this invention in its broader aspects and therefore, the appended claims are to encompass within their scope all such changes and modifications as fall within the true spirit and scope of this invention. Accordingly, the scope of the invention should not be limited to the embodiment illustrated, but by the appended claims and their legal equivalents.

I claim:

1. An ergonomic control knob assembly comprising:

a thumbwheel eccentrically mounted upon an axis of rotation within a housing said thumbwheel including an outer periphery, said outer periphery including a contact surface means, said contact surface means disposed at differing, predominantly increasing distances from said axis of rotation and wherein an output varies as a function of a distance of protrusion of said contact surface means with respect to said housing, thereby providing visual and tactile feedback to a user.

2. The assembly of claim 1 wherein said contact surface means conforms to a spiral outline.

3. The assembly of claim 1 wherein the quantity of differing distances at which said contact surface means is disposed relative to said axis of rotation approximately corresponds with the quantity of differing levels of said output.

4. The assembly of claim 1 further including:

a visual reference means, said visual reference means comprising a graphic that approximates concentric circles disposed on at least one lateral surface of said thumbwheel, the center of said graphic located about said axis of rotation.

5. The assembly of claim 4 wherein said visual reference means is of a contrasting color with the material of said thumbwheel.

6. An ergonomic control knob assembly comprising:

a thumbwheel eccentrically mounted upon an axis of rotation within a housing;

wherein said thumbwheel includes a plurality of contact regions disposed on the outer surface of said thumbwheel, said plurality of contact regions including;

a minimal radius region, disposed at a minimal distance from said axis of rotation near a first rotational extreme thumbwheel position;

a maximal radius region, disposed at a maximal distance from said axis of rotation near a second rotational extreme thumbwheel position;

a plurality of intermediate radii regions disposed at intermediate distances as measured from said axis of rotation and distributed approximately evenly between said first rotational extreme thumbwheel position and said second rotational extreme thumbwheel position thereby providing a user visual and tactile feedback regarding thumbwheel rotational position.

7. The ergonomic control knob assembly of claim 6 further including:

a finger location disposed outside said housing and proximate to said thumbwheel; and wherein the assembly outputs a first extreme output level when said minimal radius region is located at said finger location and a second extreme output level when said maximal radius region is located at said finger location and wherein said assembly outputs one of a plurality of intermediate output levels when an associated one of said plurality of intermediate radii regions is located at said finger location.

8. The ergonomic control knob assembly of claim 6 wherein said plurality of contact regions are disposed in a basically spiral shape.

9. A method for identifying the rotational position of a thumbwheel control knob comprising the steps of:

a) designing said thumbwheel control knob to include a contact surface means, said contact surface means to protrude from a housing at a plurality of different distances wherein said plurality of different distances generally increases from a minimal distance near a first rotational extreme to a maximal distance near a second rotational extreme b) rotating said thumbwheel control knob;

c) observing said thumbwheel control knob and visually noting the amount of protrusion of said contact surface means from said housing thereby identifying the rotational position of said thumbwheel control knob with visual means.

10. The method of claim 9, further including the step of:

d) measuring by contact with a hand the amount of protrusion of said contact surface means from said housing thereby also identifying the rotational position of said thumbwheel control knob with tactile means.

* * * * *